US006845638B2

(12) United States Patent
Ogata

(10) Patent No.: US 6,845,638 B2
(45) Date of Patent: Jan. 25, 2005

(54) INSULATED KNITTED FABRIC

(75) Inventor: Nobuaki Ogata, Osaka (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/475,646

(22) PCT Filed: May 29, 2002

(86) PCT No.: PCT/JP02/05214

§ 371 (c)(1),
(2), (4) Date: Oct. 23, 2003

(87) PCT Pub. No.: WO02/101134

PCT Pub. Date: Dec. 19, 2002

(65) Prior Publication Data

US 2004/0154343 A1 Aug. 12, 2004

(30) Foreign Application Priority Data

Jun. 6, 2001 (JP) ..... 2001-170810

(51) Int. Cl.[7] ..... D04B 1/14
(52) U.S. Cl. ..... 66/169 R; 442/318
(58) Field of Search ..... 66/196, 202, 197, 66/169 R, 170; 442/197, 198, 206, 208, 212, 213, 215, 217, 318

(56) References Cited

U.S. PATENT DOCUMENTS

| | | | | | |
|---|---|---|---|---|---|
| 4,733,546 | A | * | 3/1988 | Toda | 66/202 |
| 5,735,145 | A | * | 4/1998 | Pernick | 66/196 |
| 5,888,914 | A | * | 3/1999 | Katz | 442/184 |
| 6,381,994 | B1 | * | 5/2002 | Lee | 66/196 |
| 6,427,493 | B1 | * | 8/2002 | Kasdan et al. | 66/169 R |

FOREIGN PATENT DOCUMENTS

| | | | |
|---|---|---|---|
| JP | 59-71464 | A | 4/1984 |
| JP | 4-24201 | A | 1/1992 |
| JP | 9-316757 | A | 12/1997 |
| JP | 2000-8252 | A | 1/2000 |

* cited by examiner

*Primary Examiner*—Danny Worrell
(74) *Attorney, Agent, or Firm*—Sughrue Mion, PLLC

(57) ABSTRACT

An insulated knitted fabric comprises a single layer or two or more layers, wherein at least the outer layer is composed of fibers having a single filament fineness of 0.2 to 3.0 dtex; at least one layer of the knitted fabric has a stitch density of 45 courses/2.54 cm or above and 45 wales/2.54 cm or above; the air permeability of the knitted fabric is 5 to 50 cc/cm$^2$·sec and the knitted fabric is subjected to water absorptive finish. The knitted fabric is useful as general clothes materials, sport clothes materials or the like requiring high wind-breaking property and water absorbing property.

8 Claims, No Drawings

INSULATED KNITTED FABRIC

TECHNICAL FIELD

The present invention relates to an insulated knitted fabric having both wind-breaking and water absorbing properties. The insulated knitted fabric of the present invention is suitably used as general clothes materials, sport clothes materials or the like requiring high wind-breaking and water absorbing properties.

BACKGROUND ART

Knitted fabrics have soft band feeling and excellent stretchability as compared with those of woven fabrics or the like and have been widely used for general clothes and sport clothes. On the other hand, knitted fabrics have disadvantages of easiness of ventilation with coldness because of higher air permeability than that of woven fabrics when used as autumn and winter clothing.

In order to eliminate the disadvantages, several methods have hitherto been proposed so as to enhance the wind-breaking property of knitted fabrics. For example, there are known methods for coating the back surface of a knitted fabric with a resin, laminating a film onto the back surface or laminating a high-density woven fabric onto the back surface of the knitted fabric and raising the wind-breaking property or the like. Although the wind-breaking property is improved by the methods, there are problems that the sufficient water absorbing property is not usually obtained and the skin becomes sticky during perspiration and further hand feeling of the knitted fabric is hard.

On the other hand, knitted fabrics obtained by knitting water absorbing fibers or porous fibers such as cotton are known as the knitted fabrics having the water absorbing property. However, there are problems that the sufficient wind-breaking property is not obtained though the water absorbing property is excellent simply by knitting known knitted fabrics using the water absorbing fibers or porous fibers.

For the reasons described above, supply of insulated knitted fabrics having both performances of wind-breaking and water absorbing properties has been demanded.

DISCLOSURE OF THE INVENTION

It is an object of the present invention to provide an insulated knitted fabric having both wind-breaking and water absorbing properties and excellent comfortableness to wear without greatly changing hand feeling, appearance grade and characteristics of the knitted fabric.

The object can be achieved by the insulated knitted fabric of the present invention.

The insulated knitted fabric of the present invention is a knitted fabric comprising a single layer or two or more layers, characterized in that at least an outer layer is composed of fibers having a single filament fineness of 0.2 to 3.0 dtex; at least one layer of the knitted fabric has a stitch density of 45 courses/2.54 cm or above and 45 wales/2.54 cm or above; the air permeability of the knitted fabric is 5 to 50 $cc/cm^2 \cdot sec$ and the knitted fabric is subjected to water absorptive finish.

In the insulated knitted fabric of the present invention, the fibers constituting at least the outer layer are preferably a fast-twist crimped yarn having a percentage of crimp of 3 to 45% for enhancing wind-breaking effects of the knitted fabric.

The number of layers constituting the insulated knitted fabric of the present invention is two and the ratio of (single filament fineness of the fibers constituting the outer layer) to (single filament fineness of the fibers constituting the inner layer) is preferably 1:2 to 1:5 from aspects of the water absorbing property.

In the insulated knitted fabric of the present invention, the stitch density of at least one layer is preferably within the range of 50 to 125 courses/2.54 cm and 50 to 80 wales/2.54 cm.

In the insulated knitted fabric of the present invention, at least one layer is preferably composed of a highly shrinkable yarn having a shrinkage (boiling water) of 8 to 45% from aspects of the wind-breaking property.

In the insulated knitted fabric of the present invention, at least one layer is preferably composed of an elastic yarn having an elongation of 200 to 900% and a stretch elastic recovery of 50 to 120%.

Furthermore, in the present invention, when the insulated knitted fabric of the present invention is subjected to heat treatment such as dyeing, values before the heat treatment are used as values of the percentage of crimp, elongation, stretch elastic recovery and shrinkage (boiling water).

At least either one of lateral faces of the insulated knitted fabric of the present invention is preferably subjected to raising.

The insulated knitted fabric of the present invention has preferably a value within 2 seconds expressed in terms of the water absorbing property measured by the dropping test described in JIS L-1907.

BEST MODE FOR CARRYING OUT THE INVENTION

The insulated knitted fabric of the present invention comprises a single layer or two or more layers. In the insulated knitted fabric of the present invention, the number of layers is not especially limited; however, two layers of an outer layer and an inner layer or three layers of the outer layer, middle layer and inner layer are preferable from aspects of imparting diverse functions while maintaining soft hand feeling. In particular, the insulated knitted fabric of the present invention has more preferably a two-layer structure of the outer layer and the inner layer from aspects of production cost. The inner layer is a layer located on the innermost side contacting the skin when the insulated knitted fabric of the present invention is used and the outer layer is a layer located on the outermost side contacting the open air when the insulated knitted fabric of the present invention is used.

As the kind of the fibers constituting each layer, natural fibers such as cotton, silk, hemp or wool, regenerated fibers such is rayon, semisynthetic fibers such as acetate and synthetic fibers such as polyester, polyamide, polyolefin or polyacrylonitrile can be used. Among them, the whole layers are preferably composed of polyester fibers. The polyester fibers herein described are composed of polyesters comprising terephthalic acid as a principal dicarboxylic acid component and at least one kind of glycol, preferably at least one kind of alkylene glycol selected from ethylene glycol, trimethylene glycol, tetramethylene glycol and the like as a principal glycol component. One or more kinds such as a micropore-forming agent, a cationic dye-dyeability-imparting agent, a discoloration preventing agent, a heat stabilizer, a flame retardant, a fluorescent brightener, a delustering agent, a colorant, an antistatic agent, a hygroscopic agent, an antimicrobial agent or inorganic fine particles, if necessary, may be added within the range without deteriorating the object of the present invention. The cross-sectional shape of the single filaments of the fibers is not especially limited, and known cross-sectional shapes such as a circular or a triangular shape can be adopted. The cross-sectional shape may have a hollow part or may be a conjugated yarn.

In the insulated knitted fabric of the present invention, it is necessary that the single filament fineness of the fibers constituting at least the outer layer (the outer layer is read in a different way as the single layer when the knitted fabric comprises the single layer; the same shall apply hereinafter) is within the range of 0.2 to 3.0 dtex (preferably 0.3 to 1.0 dtex). When the single filament fineness is within the range, the covering property of stitches is improved to readily obtain both wind-breaking effects and the excellent water absorbing property by capillary actions. When the single filament fineness is less than 0.2 dtex, it is unfavorable because pilling and snagging resistances of the knitted fabric are deteriorated though the covering property of the stitches is improved. On the other hand, when the single filament fineness exceeds 3.0 dtex, it is unfavorable because the covering property of the stitches is lowered and it is therefore difficult to impart the wind-breaking property to the knitted fabric. Although the total fineness and filament count of the fibers constituting the outer layer are not especially limited, the total fineness is within the range of preferably 30 to 100 dtex (more preferably 40 to 80 dtex) and the filament count is within the range of preferably 30 to 100 (more preferably 35 to 80) in aspects of hand feeling, respectively.

Further, in the insulated knitted fabric of the present invention, it is necessary to keep the stitch density of at least one layer at 45 courses or above (preferably 50 to 120 courses)/2.54 cm and 45 wales or above (preferably 50 to 80 wales)/2.54 cm. When the knitted fabric density is less than 45 courses/2.54 cm or less than 45 wales/2.54 cm, it is unfavorable because the sufficient wind-breaking property is not obtained. When the knitted fabric density exceeds 120 courses/2.54 cm or 80 wales/2.54 cm, there is some fear of deteriorating the water absorbing property or damaging soft hand feeling because the density is too high though the wind-breaking property is obtained. When the insulated knitted fabric of the present invention comprises two or more layers, it is preferable that the stitch density of the whole layers is within the range described above and the stitch density (number of courses and number of wales) of each layer is the same.

It is necessary that the insulated knitted fabric of the present invention has an air permeability of 5 to 50 $cc/cm^2 \cdot sec$ or less (preferably 7 to 40 $cc/cm^2 \cdot sec$). When the air permeability exceeds 50 $cc/cm^2 \cdot sec$, it is unfavorable because the wind-breaking property is low. On the contrary, when the air permeability is less than 5 $cc/cm^2 \cdot sec$, it is unfavorable because low air permeability imparts sweatiness or a sticky feeling when clothes using the knitted fabric are worn. The knitted fabric having the air permeability within the range is obtained by suitably selecting yarn constitution and stitch density, knitting the fibers with a warp knitting machine or a circular knitting machine of 28 gauges or more and, if necessary, carrying out dyeing. A known knitting pattern of a warp knitting or a circular knitting pattern can be used as the knitted fabric pattern without special limitations; however, a half stitch, a half base stitch, a satin stitch or the like using two reeds or three reeds are preferably exemplified from aspects of the wind-breaking property.

It is necessary to subject the insulated knitted fabric of the present invention to water absorptive finish. The water absorbing property which is one of main objects of the present invention is obtained by subjecting the knitted fabric to the water absorptive finish. Preferred examples of a method for subjecting the knitted fabric to the water absorptive finish include finish of the knitted fabric with a hydrophilizing agent such as a polyethylene glycol diacrylate or its derivative or a polyethylene terephthalate-polyethylene glycol copolymer in the same bath during dyeing. The pickup of the hydrophilizing agent is preferably within the range of 0.25 to 0.50% by weight based on the weight of the insulated knitted fabric. The water absorbing property of the knitted fabric is preferably 2 seconds or below (more preferably 1 second or below) measured by the dropping test described in JIS L-1907.

In the insulated knitted fabric of the present invention, the shape of the fibers constituting each layer may be multifilaments or staple fibers; however, a false-twist crimped yarn obtained by subjecting multifilaments to false-twist crimping or a composite textured yarn prepared by forming the false-twist crimped yarn into a composite with another filament yarn is preferably used for improving covering property of the stitches. Yarns subjected to Taslan texturing, interlacing or twisting may be used. Among them, the fibers constituting the outer layer are preferably a false-twist crimped yarn from aspects of the wind-breaking property. The false-twist crimped yarn is preferably a false-twist crimped yarn having a percentage of crimp of 3 to 45% (especially preferably 10 to 30%). When the percentage of crimp is less than 3%, there is some fear of insufficiently exhibiting covering effects of the crimped yarn on the stitches. When the percentage of crimp exceeds 45%, there is a tendency to lower the hand feeling of the knitted fabric. The false-twist crimped yarn can be produced by a known method. Spindle false twisting, friction disk false twisting and belt false twisting can be exemplified as methods for false-twist texturing and any methods for false-twist texturing can be selected.

In the insulated knitted fabric of the present invention, the single filament fineness of the fibers constituting layers other than the outer layer can optionally be selected; however, the ratio of (single filament fineness of the fibers constituting the outer layer) to (single filament fineness of the fibers constituting the inner layer) is preferably 1:2 to 1:5 from aspects of the water absorbing property. When the knitted fabric has a plurality of layers and the ratio of the single filament fineness of the fibers constituting the inner and outer layers is kept within the range, it is preferable because sweat exuded from the skin during perspiration is rapidly diffused through the inner layer to the side of the outer layer to provide excellent sweat-absorbing and quick-drying properties. In the process, the total fineness and filament count of the fibers constituting the layers other than the outer layer are not especially limited; however, the total fineness is preferably within the range of 30 to 100 dtex (more preferably 32 to 80 dtex) and the filament count is within the range of preferably 10 to 80 (more preferably 20 to 50).

In order to further enhance the wind-breaking property, the knitted fabric is a multilayered structure of two or more layers and at least one layer of the knitted fabric (more preferably the middle layer and/or the inner layer of the knitted fabric) is preferably composed of a highly shrinkable polyester filament yarn. Since the elongation of the knitted fabric can be limited and a high density can be maintained by the construction of the knit, excellent wind-breaking property is obtained. Known yarns are used as the highly shrinkable polyester filament yarn and a low-oriented yarn of polyethylene terephthalate or a polyester prepared by copolymerizing ethylene terephthalate as main repeating units with 8 to 30 mol % (based on the terephthalic acid component) of a third component is exemplified. Examples of the third component used may include bifunctional dicarboxylic acids such as isophthalic acid, naphthalenedicarboxylic acid, adipic acid or sebacic acid, diol compounds or the like such or the like as neopentyl glycol, butanediol, diethylene glycol or propylene glycol. The highly shrinkable polyester filament yarn having the shrinkage (boiling water) within the range of 8 to 45% is preferably used.

In the insulated knitted fabric of the present invention, stretchability in addition to the wind-breaking and water absorbing properties which are main objects of the present invention can be imparted by forming the knitted fabric into a multilayered structure of two or more layers, arranging an elastic yarn in at least one layer (preferably the middle layer and/or the inner layer of the knitted fabric) and carrying out knitting. Examples of the elastic yarn include a polyether-ester elastic yarn or a polyurethane elastic yarn and, among them, an elastic yarn having an elongation of 200 to 900% (more preferably 500 to 800%) and an elastic recovery of 50 to 98% (more preferably 70 to 95%) is especially preferably exemplified.

Further, in the insulated knitted fabric of the present invention, insulated effects can be enhanced by carrying out raising on at least either repellent, a heat storage medium, an ultraviolet screening, an antistatic agent, an antimicrobial agent, a deodorant, a mothproof agent, a luminous agent, a retro-reflecting agent and the like may added and applied to the insulated knitted fabric of the present invention according to uses and types of usage. As mentioned above, in the present invention values before heat treatment are used as values of elongation, percentage of crimp, stretch elastic recovery and shrinkage (boiling water) of the fibers in the present invention when the insulated knitted fabric of the present invention is subjected to heat treatment such as dyeing or calendering.

EXAMPLES

The insulated knitted fabric of the present invention will be explained specifically hereafter with examples which are not intended to limit the present invention at all. Characteristics used in the examples were measured as follows.

(1) Percentage of Crimp

Rewinding was carried out by using a rewinding frame having a frame perimeter of 1.125 m under a load of 49/50 mN×9×total tex (0.1 g×total denier) applied thereto at a constant speed to prepare small hanks having a number of turns of 10. The resulting small hanks were formed into a twisted double loop shape and applied to a crimp measuring plate and an initial load of 49/2500 mN×20×9×total tex (2 mg×20×20×total denier) and a heavy load of 98/50 mN×20×9×total dtex (0.2 g×20×total denier) were applied. A hank length L0 was then measured after the passage of 1 minute. After the measurement, the heavy load was immediately removed. After the passage of 1 minute or more, the hank was introduced into boiling water while applying the initial load thereto and treated for 30 minutes. After the treatment with boiling water, the initial load was removed and the hanks were naturally dried in a free state for 24 hours. After the drying, the small hanks were reapplied to the crimp measuring plate in the same manner as described above. The initial load and heavy load were applied. After the passage of 1 minute, the hank length L1 was measured and the heavy load was immediately removed. The hank length L2 after the passage of 1 minute from the load removal was measured to one of lateral faces of the insulated knitted fabric. The raising may be carried out by a conventional method and can be performed in a step before or after dyeing.

The insulated knitted fabric of the present invention has a weight of preferably 100 g/m$^2$ or above (preferably 150 to 300 g/m$^2$) front aspects of the wind-breaking property.

Not only conventional scouring, weight-reduction finish, preheat-setting treatment, dyeing and final heat-setting treatment but also other various finishes such as application of functions of calendering, a water repellent, a heat storage medium, an ultraviolet screening, an antistatic agent, an antimicrobial agent, a deodorant, a mothproof agent, a luminous agent, a retro-reflecting agent and the like may added and applied to the insulated knitted fabric of the present invention according to uses and types of usages. As mentioned above, in the present invention, values before heat treatment are used as values of elongation, percentage of crimp, stretch elastic recovery and shrinkage (boiling water) of the fibers in the present invention when the insulated knitted fabric of the present invention is subjected to heat treatment such as dyeing or calendering.

EXAMPLES

The insulated knitted fabric of the present invention will be explained specifically hereafter with examples which are not intended to limit the present invention at all. Characteristics used in the examples were measured as follows.

(1) Percentage of Crimp

Rewinding was carried out by using a rewinding frame having a frame perimeter of 1.125 m under a load of 49/50 mN×9×total tex (0.1 g×total denier) applied thereto at a constant speed to prepare small hanks having a number of turns of 10. The resulting small hanks were formed into a twisted double loop shape and applied to a crimp measuring plate and an initial load of 49/2500 mN×20×9×total tex (2 mg×20×total denier) and a heavy load of 98/50 mN×20×9×total dtex (0.2 g×20×total denier) were applied. A hank length L0 was then measured after the passage of 1 minute. After the measurement, the heavy load was immediately removed. After the passage of 1 minute or more, the hank was introduced into boiling water while applying the initial load thereto and treated for 30 minutes. After the treatment with boiling water, the initial load was removed and the hanks were naturally dried in a free state for 24 hours. After the drying, the small hanks were reapplied to the crimp measuring plate in the same manner as described above. The initial load and heavy load were applied. After the passage of 1 minute, the hank length L1 was measured and the heavy load was immediately removed. The hank length L2 after the passage of 1 minute from the load removal was measured to calculate the percentage of crimp according to the following formula.

$$\text{Percentage of crimp } (\%)=\{(L1-L2)/L0\}\times 100.$$

(2) Air Permeability

Measurement was made by a Frazier permeometer described in JIS L-1018 to provide substitute characteristics of the wind-breaking property.

(3) Water Absorbing Property

Measurement was made by the dropping test described in JIS L-1907.

(4) Elongation

Measurement was made by the method described in JIS L-1013.

(5) Elastic Recovery Ratio

Measurement was made by the method described in JIS L-1013.

Example 1

A polyethylene terephthalate filament yarn [33 dtex, filament count: 12 and shrinkage (boiling water): 10%] was fed to a back reed and a polytethylene terephthalate false-twist crimped yarn (56 dtex, filament count: 72 and percentage of crimp: 20%) was fed to a front reed. Knitting was carried out at a gauge number of 36 by half stitches (knitting by back: 10/12 and front: 23/10) to provide a warp knitted fabric, which was then fed to a conventional scouring step to afford a knitted fabric (weight: 170 g/m$^2$ and stitch density: 95 courses/2.54 cm and 60 wales/2.54 cm in both the outer layer and the inner layer). Furthermore, the resulting knitted fabric was subjected to finish in the same bath with a hydrophilizing agent (a polyethylene terephthalate-polyethylene glycol copolymer) in a dyeing step according to a conventional method. Thereby, the hydrophilizing agent in an amount of 0.30% by weight based on the weight of the knitted fabric was applied to the knitted fabric to impart the water absorbing property. As a result, an insulated knitted fabric was obtained.

Example 2

A polyethylene terephthalate filament yarn [33 dtex, filament count: 12 and shrinkage (boiling water): 10%] was fed to a back reed and polyethylene terephthalate false-twist crimped yarns (56 dtex, filament count: 72 and percentage of crimp: 20%) were fed to a middle reed and a front reed. Knitting was carried out at a gauge number of 28 by half stitches (knitting by back: 10/12, middle: 23/10 and front: 10/23) to provide a warp knitted fabric (weight: 220 g/m$^2$ and stitch density: 75 courses/2.54 cm and 43 wales/2.54 cm in the outer layer, middle layer and inner layer). The knitted fabric was then subjected to finish in the same bath with a hydrophilizing agent (a polyethylene terephthalate-polyethylene glycol block copolymer) in a dyeing step. Thereby, the hydrophilizing agent in an amount of 0.30% by weight based on the weight of the knitted fabric was applied to the knitted fabric to impart the water absorbing property. After the dyeing, conventional raising of the back surface of the knitted fabric was carried out to afford an insulated knitted fabric.

Example 3

Polyethylene terephthalate false-twist crimped yarns (33 dtex, filament count: 36 and percentage of crimp: 20%) were fed to a back and a front reeds and a polyetherester elastic yarn (44 dtex, filament count: 1, elongation: 650% and elastic recovery: 85%) was fed to a middle reed. Knitting was carried out at a gauge number of 28 by satin stitches (knitting by back: 10/12, middle 12/10 and front: 34/10) to afford a warp knitted fabric, which was then fed to a conventional scouring step to provide a knitted fabric (weight: 259 g/m$^2$ and stitch density: 103 courses/2.54 cm and 56 wales/2.54 cm in the outer layer the middle layer and the inner layer). The resulting knitted fabric was then subjected to finish in the same bath with a hydrophilizing agent (a polyethylene terephthalate-polyethylene glycol copolymer) in a dyeing step. Thereby, the hydrophilizing agent in an amount of 0.30% by weight based on the weight of the knitted fabric was applied to the knitted fabric to impart the water absorbing property. As a result, an insulated knitted fabric was obtained.

Example 4

A warp knitted fabric was knitted by using the same yarns and same pattern as in Example 1, except that only the density was changed. The resulting knitted fabric was fed to a conventional scouring step to afford a knitted fabric (weight: 210 g/cm$^2$ and stitch density: 135 courses/2.54 cm and 81 wales/2.54 cm in both the outer layer and the inner layer). The knitted fabric was further subjected to finish in the same bath with a hydrophilizing agent (a polyethylene terephthalate-polyethylene glycol copolymer) in a dyeing step. Thereby, the hydrophilizing agent in an amount of 0.30% by weight based on the weight of the knitted fabric to the knitted fabric to impart the water absorbing property. As a result, an insulated knitted fabric was obtained.

Comparative Example 1

A polyethylene terephthalate filament yarn [84 dtex, filament count: 24 and shrinkage (boiling water): 10%] was fed to a back reed and a polyethylene terephthalate filament yarn [84 dtex, filament count: 24 and shrinkage (boiling water): 10%] was fed to a front reed. Knitting was carried out at a gauge number of 22 by half stitches (knitting by back: 10/12 and front 23/10) to afford a warp knitted fabric. The resultant warp knitted fabric was fed to a conventional scouring step to afford a knitted fabric (weight: 170 g/m$^2$ and stitch density: 60 courses/2.54 cm and 35 wales/2.54 cm in both the outer layer and the inner layer). Furthermore, the knitted fabric was subjected to finish in the same bath with a hydrophilizing agent (a copolymer of polyethylene terephthalate-polyethylene glycol). Thereby, the hydrophilizing agent in an amount of 0.30% by weight based on the weight of the knitted fabric was applied to the knitted fabric to impart the water absorbing property. As a result, a knitted fabric was obtained.

Air permeability as substitute characteristics of the windbreaking property and water absorbing property of the knitted fabrics obtained in Examples 1, 2 and 3 and Comparative Example 1 were evaluated. Table 1 shows the obtained results.

TABLE 1

| | | | Example 1 | Example 2 | Example 3 | Example 4 | (1) |
|---|---|---|---|---|---|---|---|
| Kind of Knitted Fabric | | | (2) | (2) | (2) | (2) | (2) |
| Yarns Used (Outer Layer) | | | KY | KY | KY | KY | FY |
| (Middle layer) | | | — | KY | Elastic Yarn | — | — |
| (Inner Layer) | | | FY | FY | KY | FY | FY |
| Pattern | | | Half | Half Base | Satin | Half | Half |
| Stitch | (3) | (6) | 95 | 75 | 103 | 135 | 60 |
| Density | | (7) | 60 | 43 | 56 | 81 | 35 |

TABLE 1-continued

| | | | Example 1 | Example 2 | Example 3 | Example 4 | (1) |
|---|---|---|---|---|---|---|---|
| (yarns/ | (4) | (6) | — | 75 | 103 | — | — |
| 2.54 cm) | | (7) | — | 43 | 56 | — | — |
| | (5) | (6) | 95 | 75 | 103 | 135 | 60 |
| | | (7) | 60 | 43 | 56 | 81 | 35 |
| Weight (g/m$^2$) | | | 170 | 220 | 259 | 210 | 170 |
| With or without Raising | | | Without | With | Without | Without | Without |
| Air Permeability (cc/cm$^2$ · sec) | | | 15 | 15 | 35 | 10 | 90 |
| Water Absorbing Property (seconds) | | | 1.0 | 1.0 | 1.0 | 10.0 | 1.0 |

Notes:
KY means "False-twist Crimped Yarn".
FY means "Filament Yarn".
(1) means "Comparative Example 1".
(2) means "Warp Knitted Fabric"
(3) means "Outer Layer".
(4) means "Middle Layer".
(5) means "Inner Layer".
(6) means "Number of Courses".
(7) means "Number of Wales".

As can be seen in Table 1, the surfaces of the knitted fabrics according to Examples 1 to 3 were covered with fibers having a fine single filament fineness and the knitted fabric had a prescribed stitch density. Therefore, the knitted fabrics having excellent wind-breaking property were obtained at a low air permeability and the water absorbing property was good. The knitted fabric according to Example 4 had somewhat low water absorbing property because of a high density. On the other hand, the knitted fabric in Comparative Example had high air permeability though the water absorbing property was good.

INDUSTRIAL APPLICABILITY

The insulated knitted fabric of the present invention has excellent wind-breaking and water absorbing properties in combination. Therefore, the insulated knitted fabric of the present invention is a textile material suitable for general clothes uses, sport clothes uses or the like requiring high wind-breaking property and water absorbing property.

What is claimed is:

1. An insulated knitted fabric comprising two or more layers, characterized in that at least an outer layer is composed of fibers having a single filament fineness of 0.2 to 3.0 dtex; at least one layer of the knitted fabric has a stitch density of 45 courses/2.54 cm or above and 45 wales/2.54 cm or above; the air permeability of the knitted fabric is 5 to 50 cc/cm2·sec and the knitted fabric comprises a hydrophilizing agent.

2. The insulated knitted fabric according to claim 1, wherein at least the outer layer is composed of a false-twist crimped yarn having a percentage of crimp of 3 to 45%.

3. The insulated knitted fabric according to claim 1, wherein the stitch density of at least one layer is 50 to 125 courses/2.54 cm and 50 to 80 wales/2.54 cm.

4. The insulated knitted fabric according to claim 1, wherein the knitted fabric is composed of the outer layer and the inner layer in a ratio of single filament fineness of the fibers constituting the outer layer:single filament fineness of the fibers constituting the inner layer of 1:2 to 1:5.

5. The insulated knitted fabric according to claim 1, wherein at least one layer is composed of a highly shrinkable yarn having a shrinkage in boiling water of 8 to 45%.

6. The insulated knitted fabric according to claim 1, wherein the water absorbing property measured by the dropping test described in JIS L-1907 is 2 seconds or below.

7. The insulated knitted fabric according to claim 1, wherein at least one layer is composed of an elastic yarn having an elongation of 200 to 900% and a stretch elastic recovery of 50 to 98%.

8. The insulated knitted fabric according to claim 1, wherein at least either one of lateral faces of the knitted fabric has a raised surface.

* * * * *